US009399838B2

(12) United States Patent
Laine et al.

(10) Patent No.: US 9,399,838 B2
(45) Date of Patent: Jul. 26, 2016

(54) METHOD FOR IMPROVING STRENGTH AND RETENTION, AND PAPER PRODUCT

(75) Inventors: Janne Laine, Espoo (FI); Markus Korhonen, Espoo (FI); Juha Merta, Vantaa (FI)

(73) Assignee: UPM-Kymmene Corporation, Helsinki (FI)

( * ) Notice: Subject to any disclaimer, the term of this patent is extended or adjusted under 35 U.S.C. 154(b) by 0 days.

(21) Appl. No.: 13/980,088

(22) PCT Filed: Jan. 19, 2012

(86) PCT No.: PCT/FI2012/050045

§ 371 (c)(1),
(2), (4) Date: Jul. 17, 2013

(87) PCT Pub. No.: WO2012/098296

PCT Pub. Date: Jul. 26, 2012

(65) Prior Publication Data

US 2013/0292075 A1 Nov. 7, 2013

(30) Foreign Application Priority Data

Jan. 20, 2011 (FI) ..... 20115054

(51) Int. Cl.

| | |
|---|---|
| ***D21H 15/02*** | (2006.01) |
| ***D21H 17/25*** | (2006.01) |
| ***D21H 21/10*** | (2006.01) |
| ***D21H 21/18*** | (2006.01) |
| *D21H 11/18* | (2006.01) |

(52) U.S. Cl.

CPC ..... *D21H 21/18* (2013.01); *D21H 17/25* (2013.01); *D21H 21/10* (2013.01); *D21H 11/18* (2013.01)

(58) Field of Classification Search

USPC ..... 162/141, 146, 149, 158, 164.1, 162/168.1–168.3, 181.1–181.8, 183–185

See application file for complete search history.

(56) References Cited

U.S. PATENT DOCUMENTS

| | | | | |
|---|---|---|---|---|
| 5,012,768 | A * | 5/1991 | Roschinski | 123/41.49 |
| 5,240,561 | A * | 8/1993 | Kaliski | 162/138 |
| 6,214,163 | B1 | 4/2001 | Matsuda et al. | |
| 6,551,457 | B2 * | 4/2003 | Westman et al. | 162/158 |
| 6,602,994 | B1 * | 8/2003 | Cash et al. | 536/30 |
| 6,749,721 | B2 * | 6/2004 | Shannon et al. | 162/164.4 |
| 2005/0067730 | A1 | 3/2005 | Yano et al. | |
| 2010/0155006 | A1 * | 6/2010 | Ales et al. | 162/149 |
| 2012/0043039 | A1 * | 2/2012 | Paltakari et al. | 162/157.6 |
| 2012/0132383 | A1 * | 5/2012 | Laine et al. | 162/175 |
| 2012/0227920 | A1 * | 9/2012 | Juppo et al. | 162/164.6 |
| 2012/0241114 | A1 * | 9/2012 | Axrup et al. | 162/127 |
| 2013/0108373 | A1 * | 5/2013 | Laukkanen et al. | 405/128.7 |
| 2013/0180679 | A1 * | 7/2013 | Laine et al. | 162/141 |
| 2014/0045785 | A1 * | 2/2014 | Herranen et al. | 514/57 |

FOREIGN PATENT DOCUMENTS

| | | | |
|---|---|---|---|
| EP | 0 846 703 | A1 | 6/1998 |
| JP | 8-260397 | A | 10/1996 |
| JP | 2010-209510 | A | 9/2010 |
| WO | WO 89/08148 | A2 | 9/1989 |
| WO | WO 00/47628 | A2 | 8/2000 |
| WO | WO 01/66600 | A1 | 9/2001 |
| WO | WO 2009/084566 | A | 7/2009 |
| WO | WO 2010/125247 | A2 | 11/2010 |
| WO | WO 2011/051882 | A1 | 5/2011 |
| WO | WO 2011/055017 | A1 | 5/2011 |
| WO | WO 2011/068457 | A1 | 6/2011 |

OTHER PUBLICATIONS

Hubbe, M., Mini-Encyclopedia of Papermaking Wet-End Chemistry, Precipitated Calcium Carbonate (PCC), NC State Univ., [online], p. 1, No Date, retrieved from the Internet, [retrieved Jan. 20, 2015], <URL: http://www4.ncsu.edu/~hubbe/PCC.htm>.*

Smook, Gary A., Handbook for Pulp and Paper Technologists, 2nd ed, Angus Wilde Publications, 1992, pp. 207-208.*

International Search Report for corresponding International Patent Application No. PCT/FI2012/050045 mailed Aug. 13, 2012.

Finnish Search Report for corresponding Finnish Patent Application No. 20115054 mailed Sep. 21, 2011.

Schlosser, H. "Nano-disperse cellulose and nano-fibrillated cellulose-new products for paper and board manufacture and coating", Int. Papwirtsch, 2008, pp. 41-44.

Schlosser, H. "Nano disperse cellulose und ananofibrillierte cellulose-neue produkte fur die herstellung un veredelung von papier und karton", Wochenblatt fur Papierfabrikation, vol. 136, 2008, pp. 252-263.

Chinese Office Action for corresponding Chinese Patent Application No. 201280005953.6 mailed Nov. 28, 2014 (English translation).

Chinese Office Action for corresponding Chinese Patent Application No. 201280005953.6 mailed Aug. 18, 2015. English translation provided.

(Continued)

*Primary Examiner* — Dennis Corday

(74) *Attorney, Agent, or Firm* — Merchant & Gould P.C.

(57) ABSTRACT

The invention relates to a method for improving strength and retention in the manufacture of paper. According to the invention, a composition containing microfibrillated cellulose is provided in a fiber suspension, and from 0.1 to 10 w-% of microfibrillated cellulose by mass of the fiber suspension is added to improve the strength and retention of the product to be formed. In addition, the invention relates to a corresponding paper product.

15 Claims, No Drawings

(56) References Cited

OTHER PUBLICATIONS

Third Party Observation against corresponding European Patent Application No. 12721879.0 filed Oct. 7, 2015.
Communication pursuant to Rule 114(2) EPC for corresponding European Patent Application No. 12721879.0 mailed Oct. 14, 2015.
Lindström, T., "Some Fundamental Chemical Aspects on Paper Forming", *Fundamentals of Papermaking—transactions of the Ninth Fundamental Research Symposium held at Cambridge*, 1: 311-412, (1989).
Horvath, A., "Appropriate Conditions for Polyelectrolyte Titration to Determine the Charge of Cellulosic Fibers", *Licentiate Thesis, Royal Institute of Technology, Dept. of Fibre and Polymer Technology*, 39 pgs, (2003).
Pääkko, M. et al., "Enzymatic Hydrolysis Combined with Mechanical Shearing and High-Pressure Homogenization for Nanoscale Cellulose Fibrills and Strong Gels", *Biomacromolecules*, 8(6): 1934-1941, (2007).
Ahola, S. et al., "Cellulose nanofibrils-adsorption with poly(amideamine) epichlorohydrin studies by QCM-D and application as a paper strength additive", *Cellulose*, 15: 303-314, (2008).
Lindström, tom and Lars Winter, "Mikrobibrillär cellulose som component vid papperstillverkning", STFI-Meddelande, 36 pgs, (1988), with English translation of pp. 10-18.

* cited by examiner

METHOD FOR IMPROVING STRENGTH AND RETENTION, AND PAPER PRODUCT

FIELD OF THE INVENTION

This application is a National Stage Application of PCT/FI2012/050045, filed 19 Jan. 2012, which claims benefit of Serial No. 20115054, filed 20 Jan. 2011 in Finland and which applications are incorporated herein by reference. To the extent appropriate, a claim of priority is made to each of the above disclosed applications.

The invention relates to a method for improving strength and retention in papermaking, and to a paper product.

BACKGROUND OF THE INVENTION

Known from the prior art are different methods for manufacturing paper pulp and paper products.

In addition, it is known from the prior art to improve the properties of paper products by different filler and coating materials, e.g. pigments, in connection with papermaking. It is known that the aim in papermaking is to provide the best properties possible for the paper product.

Retention and strength problems are known form papermaking. The strength, particularly dry strength, of the product to be formed is an important property of the product which is typically tried to be improved. In addition, the retention of small particles, such as fillers and fines, is important in papermaking. Retention means the ratio of the fiber and filler material remaining on the wire to the material that has been fed, i.e. it means the ability of the wire to retain fiber pulp. Know are different retention agents for improving retention. The retention agents provide suitable fixation of the fibers, fillers and other chemicals of the fiber pulp to the web. Known retention agents include e.g. polyacrylamides and combined retention agents, such as combinations of anionic and cationic retention agents. In addition, it is known to use a combination of polyacrylamide and microparticles as a retention agent.

On the other hand, it is known from the prior art to manufacture microfibrillated cellulose and use it in the manufacture of paper pulp and paper products. In studies on microfibrillated cellulose, it has been found that microfibrillated cellulose improves the strength of paper, i.a. Microfibrillated cellulose has a large specific surface area and has thus more bonding area relative to material weight.

OBJECTIVE OF THE INVENTION

The objective of the invention is to disclose a new type of a method for improving strength as well as retention in papermaking, and a corresponding paper product.

SUMMARY OF THE INVENTION

The method and the corresponding paper product according to the invention are characterized by what has been presented in the claims.

The invention is based on a method for improving strength and retention in papermaking. According to the invention, a composition containing microfibrillated cellulose is provided in a fiber suspension, preferably paper pulp, and from 0.1 to 10 w-% of microfibrillated cellulose by mass of the fiber suspension is added to improve the strength, e.g. dry strength, tensile strength of dry paper, internal bond strength and/or initial wet strength, and retention of the product to be formed.

Fiber suspension in this context means any suspension of fiber-based pulp containing a fiber-based composition that may be formed from any plant-based raw material, e.g. wood-based raw material, such as hardwood raw material or softwood raw material, or other plant raw material containing fibers, such as cellulose fibers. The fiber suspension may be fiber-based pulp formed by a chemical method wherein the fibers have been separated from each other and most of the lignin has been removed by chemicals using a chemical method that may be e.g. a sulfate process, sulfite process, soda process, a process based on organic solvents or other chemical treatment method known per se in the art. Alternatively, the fiber suspension may be fiber-based pulp formed by a mechanical method, for example TMP, PGW, CTMP or the like.

In one embodiment, the composition containing microfibrillated cellulose may be in the form of a dispersion, e.g. in a gel-type or gelatinous form or in the form of a diluted dispersion, or in the form of a suspension, e.g. aqueous suspension. Preferably, the composition containing microfibrillated cellulose is in the form of an aqueous suspension. The composition may contain from more than 0% to less than 100 w-% of microfibrillated cellulose. In one embodiment, the composition may consist mainly of microfibrillated cellulose. In addition to microfibrillated cellulose, the composition may contain other suitable components, e.g. fibers that may be formed from any plant-based raw material, and/or different additives and/or fillers.

Microfibrillated cellulose in this context means cellulose consisting of microfibrils, i.e. a set of isolated cellulose microfibrils and/or microfibril bundles derived from a cellulose raw material. Cellulose fibers contain microfibrils that are strand-like structural components of the cellulose fibers. The cellulose fiber is provided fibrous by fibrillating. The aspect ratio of microfibrils is typically high; the length of individual microfibrils may be more than one micrometer and the number-average diameter is typically less than 20 nm. The diameter of microfibril bundles may be larger but generally less than 1 μm. The smallest microfibrils are similar to the so-called elementary fibrils, the diameter of which is typically from 2 to 4 nm. The dimensions and structures of microfibrils and microfibril bundles depend on the raw material and production method.

Microfibrillated cellulose may have been formed from any plant-based raw material, e.g. wood-based raw material, such as hardwood raw material or softwood raw material, or other plant-based raw material containing cellulose. Plant-based raw materials may include e.g. agricultural waste, grasses, straw, bark, caryopses, peels, flowers, vegetables, cotton, maize, wheat, oat, rye, barley, rice, flax, hemp, abaca, sisal, kenaf, jute, ramie, bagasse, bamboo or reed or their different combinations.

Microfibrillated cellulose may also contain hemicellulose, lignin and/or extractives, the amount of which depends on the raw material used. Microfibrillated cellulose is isolated from the above-described raw material containing cellulose by an apparatus suitable for the purpose, e.g. a grinder, pulverizer, homogenizer, fluidizer, micro- or macrofluidizer, cryocrushing and/or ultrasonic disintegrator. Microfibrillated cellulose may also be obtained directly by a fermentation process using microorganisms e.g. from the genera *Acetobacter, Agrobacterium, Rhizobium, Pseudomonas* or *Alcailgenes*, most preferably from the genera *Acetobacter* and most preferably of all from the species *Acetobacter xylinum* or *Acetobacter pasteurianus*. Raw materials of microfibrillated cellulose may also include for example the tunicates (Latin: tunicata) and organisms belonging to the chromalveolate groups (Latin: chromalveolata), e.g. the water molds (Latin: oomycete), that produce cellulose.

In one embodiment, microfibrillated cellulose may be any chemically or physically modified derivative of cellulose or microfibril bundles consisting of microfibrils. The chemical modification may be based on e.g. a carboxymethylation, oxidation, esterification and etherification reaction of the cellulose molecules. The modification may also be carried out by physical adsorption of anionic, cationic or non-ionic agents or their combinations to the surface of cellulose. The modification may be performed before, during or after the manufacture of microfibrillated cellulose.

Microfibrillated cellulose may be formed from a cellulose-based raw material by any manner known per se in the art. In one embodiment, microfibrillated cellulose is formed from a dried and/or concentrated cellulose raw material by fibrillating. In one embodiment, the cellulose raw material has been concentrated. In one embodiment, the cellulose raw material has been dried. In one embodiment, the cellulose raw material has been dried and concentrated. In one embodiment, the cellulose raw material has been chemically pretreated to disintegrate more easily, i.e. labilized, in which case microfibrillated cellulose is formed from the chemically labilized cellulose raw material. For example, a N-oxyl (e.g. 2,2,6,6-tetramethyl-1-piperidine N-oxide)-mediated oxidation reaction provides a very labile cellulose raw material that is exceptionally easily disintegrated into microfibrillated cellulose. Such a chemical pretreatment is described for example in patent applications WO 09/084566 and JP 20070340371.

The fibrils of microfibrillated cellulose are fibers that are very long relative to the diameter. Microfibrillated cellulose has a large specific surface area. Therefore, microfibrillated cellulose is able to form multiple bonds and bind many particles. In addition, microfibrillated cellulose has good strength properties.

In one embodiment, microfibrillated cellulose is at least partially or mainly nanocellulose. Nanocellulose consists at least mainly of nano-size class fibrils, the diameter of which is less than 100 nm but the length of which may also be in the pm-size class or below. Alternatively, microfibrillated cellulose may also be referred to as nanofibrillated cellulose, nanofibril cellulose, nanofibers of cellulose, nanoscale fibrillated cellulose, microfibril cellulose or microfibrils of cellulose. Preferably, microfibrillated cellulose in this context does not mean so-called cellulose nanowhiskers or microcrystalline cellulose (MCC).

In one embodiment of the invention, a composition containing cationic microfibrillated cellulose is added to the fiber suspension.

In one embodiment of the invention, a composition containing anionic microfibrillated cellulose is added to the fiber suspension.

In one embodiment of the invention, the composition contains a component containing microfibrillated cellulose, and a filler, e.g. PCC.

In one embodiment of the invention, the composition contains a component containing microfibrillated cellulose, and a fiber-based solid material, e.g. fines.

In one embodiment, the composition contains an additive, e.g. an AKD sizing agent, ASA sizing agent or corresponding additives.

In one embodiment of the invention, the component containing microfibrillated cellulose in the composition is anionic. In one embodiment, the component containing microfibrillated cellulose is anionic and the filler is cationic.

In one embodiment of the invention, the component containing microfibrillated cellulose in the composition is cationic. In one embodiment, the component containing microfibrillated cellulose is cationic and the filler is anionic.

In one embodiment of the invention, a composition containing anionic and/or cationic microfibrillated cellulose is added to the fiber suspension including a filler. In one embodiment, a composition containing anionic microfibrillated cellulose is added to the fiber suspension including as a filler a cationic filler, e.g. PCC.

In one embodiment of the invention, a composition containing anionic and/or cationic microfibrillated cellulose is added to the fiber suspension including fines, in one embodiment fiber-based fines.

In one embodiment, a composition containing anionic and/or cationic microfibrillated cellulose is added to the fiber suspension including an additive.

In one embodiment, a composition containing anionic and/or cationic microfibrillated cellulose is added to the fiber suspension including a filler, fines and/or an additive.

In one embodiment of the invention, a cationic polyelectrolyte is added to the composition containing microfibrillated cellulose.

In one embodiment of the invention, an anionic polyelectrolyte is added to the composition containing microfibrillated cellulose.

In one embodiment of the invention, inorganic nano- and/or microparticles, e.g. $SiO_2$ particles, are added to the composition containing microfibrillated cellulose. In one embodiment, inorganic nano- and/or microparticles are added to the composition containing cationic microfibrillated cellulose. In one embodiment, a polyelectrolyte and inorganic nano- and/or microparticles are added to the composition containing microfibrillated cellulose.

In one embodiment of the invention, from 1 to 5 w-%, in one preferred embodiment from 1 to 3 w-%, of microfibrillated cellulose by mass of the fiber suspension is added to the fiber suspension.

In one embodiment of the invention, at least part of the retention chemicals and/or strength chemicals is replaced by the composition containing microfibrillated cellulose. In one embodiment, part of the conventional retention chemicals and/or strength chemicals is replaced by the composition containing microfibrillated cellulose. In one embodiment, the conventional retention chemicals and/or strength chemicals are entirely replaced by the composition containing microfibrillated cellulose. In one embodiment wherein the conventional retention chemicals are entirely replaced, a composition containing both cationic microfibrillated cellulose and anionic microfibrillated cellulose is used. In one embodiment, one of the components, e.g. a polymer component or microparticle component, is replaced in a 2-component retention arrangement. In one embodiment wherein a polymer component is replaced, a composition containing cationic microfibrillated cellulose is used. In one embodiment wherein a microparticle component is replaced, a composition containing anionic microfibrillated cellulose is used. In one embodiment, at least one component in a multicomponent retention arrangement is replaced.

In one embodiment of the invention, the method is used in the manufacture of a fiber suspension containing microfibrillated cellulose. In one embodiment of the invention, the method is used in the manufacture of paper pulp.

In one embodiment of the invention, the method is used in papermaking. The method according to the invention can be applied for use in the manufacture of different paper products wherein the paper product is formed from the fiber-based composition. A paper product in this context means any fiber-based paper, board or fiber product or an equivalent product. The paper product may have been formed from chemical pulp, mechanical pulp, chemimechanical pulp, recycled pulp, fiber pulp and/or plant-based pulp. The paper product may contain suitable fillers and additives as well as different surface treatment and coating agents.

In one embodiment of the invention, the method is used in the manufacture of a product containing microfibrillated cellulose, e.g. in the manufacture of different compositions and mixtures, preferably in the manufacture of precipitated compositions and mixtures, in the manufacture of different films, in the manufacture of different composite products or in equivalent cases. In one embodiment, the method is mainly used in the manufacture of a product containing microfibrillated cellulose, such as in the manufacture of a precipitated microfibril cellulose suspension or in the manufacture of films formed from microfibrillated cellulose.

In addition, the invention is based on a corresponding paper product formed from the fiber-based composition. According to the invention, the paper product contains microfibrillated cellulose such that a composition containing microfibrillated cellulose has been added to a fiber suspension, containing the fiber-based composition, in an amount of from 0.1 to 10 w-% by mass of the fiber suspension, and the paper product has an improved retention and strength.

The invention provides considerable advantages relative to the prior art.

Thanks to the invention, the retention and strength in a paper product containing microfibrillated cellulose can be improved. The retention of the filler or retention of the additive or retention of the entire fiber suspension can be influenced by the solution according to the invention.

Thanks to the invention, the quality of the paper product to be formed can be improved and additionally the raw material and energy expenditures can be reduced.

The method according to the invention is easily industrially applicable.

In addition, the invention provides for a new method of use for microfibrillated cellulose.

DETAILED DESCRIPTION OF THE INVENTION

The invention will be described in more detail by the accompanying examples.

EXAMPLE 1

The retention of a fiber suspension containing PCC was studied. Nanocellulose was added to the fiber suspension. The fiber suspension was the pulp to be used for the manufacture of a paper product.

Anionic nanocellulose was used to bind cationic particles, such as precipitated calcium carbonate (PCC), in order to increase the retention of fines in the fiber suspension. 3 w-% of anionic nanocellulose was added to the fiber suspension containing 20 w-% of precipitated calcium carbonate (PCC). Sheets were formed from the fiber suspension. The retention was determined for the obtained sheet to which nanocellulose had been added. As a reference, the retention was also determined for a sheet formed from a fiber suspension containing 20 w-% of precipitated calcium carbonate (PCC) but no nanocellulose. In addition, the wet strengths were determined for the sheets.

It was found that the retention of the filler, i.e. PCC, could be significantly improved by the solution according to the invention. The retention was improved from 62% to 84%. In addition, it was found that the dry strength of the product was improved. It was discovered that the effect was provided by virtue of the physical and chemical properties of nanocellulose. Due to the wide specific surface area of nanocellulose and high aspect ratio of the microfibrils, nanocellulose formed a network structure within the product composition already at very diluted aqueous suspensions, which improved both strength and retention. It was found that anionic nanocellulose flocked cationic PCC, whereby it is more effectively retained by the fibers.

In addition, the effect of the amount of addition of nanocellulose on the retention was studied. It was found that as the amount of nanocellulose increased from 1 w-% to 3 w-% in the fiber suspension including 20 w-% of precipitated calcium carbonate, the retention of precipitated calcium carbonate increased from 75% to 82%. In addition, it was found that as the amount of nanocellulose increased from 3 w-% to 6 w-%, the retention of precipitated calcium carbonate slightly increased further, yet not significantly.

EXAMPLE 2

The effect of addition of cationic nanocellulose on the dry strength of a product was studied using the tensile index. 20, 30 and 45 mg/g of cationic nanocellulose were added to fiber pulp 1 including a small amount of fines (10 min. grinding) and to fiber pulp 2 including more fines (30 min. grinding). Sheets were formed from the fiber pulps and the strengths were determined. Pine chemical pulp was used as the fiber pulp.

It was found that the strength of the sheet formed from fiber pulp 1 was lower than the strength of the product formed from a reference composition including 10 mg/g of cationic starch and 20, 30 and 45 mg/g of anionic nanocellulose. In addition, it was found that the strength of the sheet formed from fiber pulp 2 was clearly better that the strength of the sheet formed from fiber pulp 1. Thus, the effect of cationic nanocellulose on the strength was clearly higher, which was due to the fact that cationic nanocellulose retained the fines, whereby the strength of the sheet was improved. On this basis, starch can be replaced by nanocellulose for a strengthening purpose.

The method according to the invention is suitable in different applications to be used for manufacturing most different products.

The invention is not limited merely to the examples referred to above; instead, many variations are possible within the scope of the inventive idea defined by the claims.

The invention claimed is:

1. A method for improving strength and retention of a product in papermaking comprising adding a composition containing anionically modified microfibrillated cellulose and an anionic polyelectrolyte to a fiber suspension, wherein the fiber suspension comprises one or more cationic fillers, and wherein from 1 to 10 w-% of the anionically modified microfibrillated cellulose by mass of the fiber suspension is added to the fiber suspension to improve the strength and retention of the product to be formed.

2. The method according to claim 1, wherein cellulose or microfibril bundles consisting of microfibrils are modified and microfibrillated to form anionically modified microfibrillated cellulose.

3. The method according to claim 1, wherein the composition contains a component containing microfibrillated cellulose, and a filler.

4. The method according to claim 1, wherein the composition contains a component containing microfibrillated cellulose, and fiber-based solid material.

5. The method according to claim 1, wherein the composition containing microfibrillated cellulose is added to a fiber suspension including fines.

6. The method according to claim 1, wherein inorganic nanoand/or microparticles are added to the composition containing microfibrillated cellulose.

7. The method according to claim 1, wherein from 1 to 5 w-% of microfibrillated cellulose by mass of the fiber suspension is added to the fiber suspension.

8. The method according to claim 1, wherein at least part of retention chemicals and/or strength chemicals is replaced by the composition containing microfibrillated cellulose.

9. The method according to claim 1, wherein a composition containing cationic microfibrillated cellulose is added to the fiber suspension.

10. The method of claim 1, wherein the product is paper.

11. The method of claim 1, wherein the product is a product containing microfibrillated cellulose.

12. The method according to claim 1, wherein the composition containing microfibrillated cellulose further includes AKD or ASA sizing agent.

13. A method for manufacturing a modified fiber suspension by adding a composition containing anionically modified microfibrillated cellulose and an anionic polyelectrolyte to a fiber suspension, wherein the fiber suspension comprises one or more cationic fillers, and wherein from 1 to 10 w-% of the anionically modified microfibrillated cellulose by mass of the fiber suspension is added to the fiber suspension to improve strength and retention of a product to be formed from the modified fiber suspension.

14. A method for improving strength and retention of a product in papermaking comprising adding a composition containing anionically modified microfibrillated cellulose and a cationic microfibrillated cellulose to a fiber suspension, wherein the fiber suspension comprises one or more cationic fillers, and wherein from 1 to 10 w-% of the anionically modified microfibrillated cellulose by mass of the fiber suspension is added to the fiber suspension to improve the strength and retention of the product to be formed.

15. The method of claim 14, wherein the composition containing anionically modified microfibrillated cellulose and cationic microfibrillated cellulose also contains a cationic polyelectrolyte.

* * * * *